United States Patent [19]

Garritano et al.

[11] Patent Number: 5,071,368

[45] Date of Patent: Dec. 10, 1991

[54] BATTERY JUMPER CABLE ASSEMBLY

[75] Inventors: Mario Garritano, Oak Lawn; Howard O. Wedell, Jr., Oak Forest, both of Ill.

[73] Assignee: Methode Electronics, Inc., Chicago, Ill.

[21] Appl. No.: 675,649

[22] Filed: Mar. 27, 1991

[51] Int. Cl.[5] ..... H01R 11/00

[52] U.S. Cl. ..... 439/504; 439/495; 439/768

[58] Field of Search ..... 439/502, 504, 495, 754, 439/755, 768

[56] References Cited

U.S. PATENT DOCUMENTS

| | | | |
|---|---|---|---|
| 3,212,046 | 10/1965 | Abel et al. | 439/502 |
| 3,587,030 | 6/1971 | Ohnsorg et al. . | |
| 4,049,335 | 9/1977 | Julian et al. . | |
| 4,932,896 | 6/1990 | Julian . | |

*Primary Examiner*—Paula A. Bradley

*Attorney, Agent, or Firm*—Allegretti & Witcoff, Ltd.

[57] ABSTRACT

An improved battery jumper cable assembly having two or more battery terminals for interconnecting a plurality of truck batteries in line, the jumper cable assembly including a length of conductive flat cable, at least one take-off stud mounted in association with the cable, and a plate member to which the stud is mounted, the plate member being assembled to a portion of the length of the flat cable to aid in mounting the stud.

23 Claims, 4 Drawing Sheets

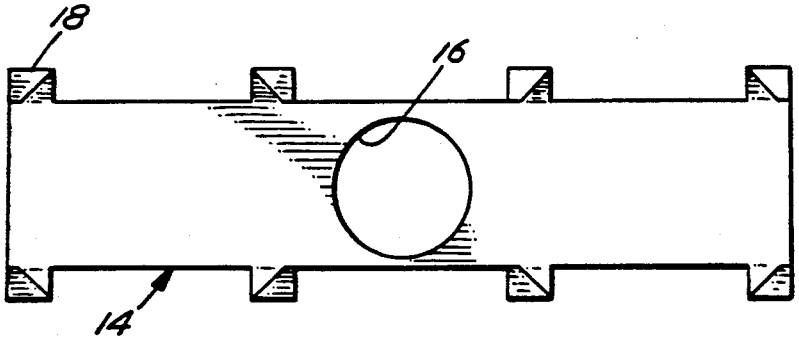
Fig. 8
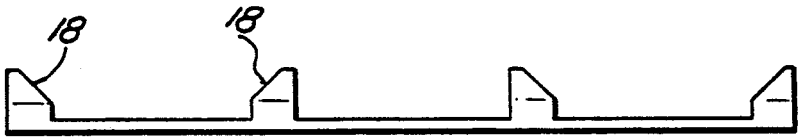
Fig. 9
Fig. 10
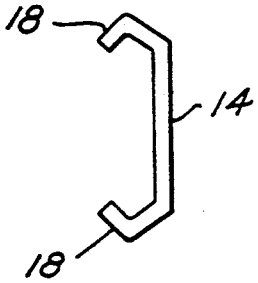
Fig. 11
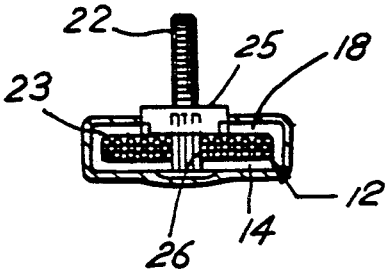
Fig. 12
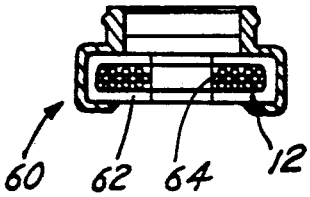
Fig. 13
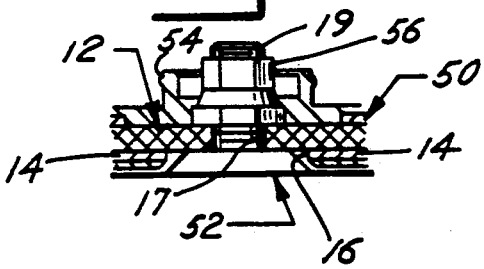

BATTERY JUMPER CABLE ASSEMBLY

BACKGROUND OF THE INVENTION

Field of the Invention

The present invention relates to a battery jumper cable assembly intended to interconnect two or more truck batteries to one another as well as connect such truck batteries to a starter and also to control circuitry in a truck.

A common prior art battery jumper cable assembly for connecting multiple truck batteries is shown in Julian et al. U.S. Pat. No. 4,288,504. The Julian et al. '504 patent shows the use of round, insulated cables which are completely stripped in the area of a battery terminal. A round tube, made of conductive metal such as copper, is then assembled over the stripped area of the round cable, and the tube is flattened on the cable. Thereafter, a hole is punched through the assembled tube and stripped cable portion to receive therethrough a battery stud.

In the foregoing manner, by use of a flattened copper tube applied over a stripped area of insulated, round cable, a battery stud is passed through the hole in the tube thereby creating electrical contact between the battery stud and the flattened, copper tube which in turn is in electrical contact with the stripped portion of the cable. The jumper assembly may be bolted down by means of a bolt applied over the projecting end of the battery stud.

One object of the present invention is to avoid the need for insulated cable which must be stripped of insulation in the area of a terminal connection.

Another object of our invention is to avoid the use of round cable and instead provide a battery jumper cable assembly made from uninsulated, flat, braided cable, thereby avoiding the need for a flattening operation to create a terminal connection, and avoid the need for stripping of insulation.

Another feature of the prior art Julian et al. '504 patent is that such a known system utilizes a common stud for connection with multiple terminals. For example, a stud which is utilized to receive a terminal from a series of batteries is also utilized to receive a terminal on a cable which leads to the truck starter, thereby necessitating the stacking of terminals on a common stud. In accordance with a preferred embodiment of the present invention, separate studs are provided on the jumper cable assembly for receiving a take-off cable to a truck starter and a take-off cable to control circuitry in a truck, such studs being separate from the connection of the jumper cable assembly to the series of batteries, and thereby avoiding the need to stack terminals.

An important advantage in the use of flat, braided cable for our improved battery jumper cable assembly is that such cable is especially adaptable to permitting vertical shifting of interconnected batteries relative to one another as commonly occurs when a truck is being driven, particularly on a bumpy road. Such flat cable is oriented in a generally horizontal plane to readily accommodate bending as the batteries shift vertically relative to one another.

An important feature of our improved truck battery jumper cable system relates to a generally flat plate which is combined with a section of the flat cable in the area where the jumper assembly is connected to a take-off cable to a truck starter, as well as a separate take-off to control circuitry in a truck, such area including a terminal for connection to one of a plurality of batteries to be interconnected by the jumper cable assembly.

In accordance with the present invention, a battery jumper cable assembly is provided which includes multiple terminals, one for each truck battery to be interconnected, and in addition includes one stud for cooperation with a lead or take-off to the truck starter and another stud for cooperation with a lead or take-off to auxiliary equipment or control circuitry in a truck. The latter two take-off studs are preferably located adjacent to one of the jumper cable terminals which cooperates with a battery stud.

For example, in a preferred embodiment to be described herein, one of the jumper terminals which cooperates with a battery stud has located on one side thereof a take-off stud which cooperates with a lead to such control circuitry, and has located on the other side thereof a stud which cooperates with a lead to a truck starter. In accordance with the invention, the foregoing grouping or cluster of a terminal and two studs is formed by a unique combination of a relatively rigid plate which is affixed to a portion of the length of flat cable to afford important advantages.

According to the present invention, the foregoing flat plate or bracket is assembled onto a length of the flat cable, such as by projecting arms on the plate which are bent around the sides of the cable in secure fashion. The flat plate or bracket is pre-formed with a relatively large central opening or hole to permit a conductive battery post to pass therethrough into face-to-face contact with the flat, braided cable to which the plate is attached.

After assembly of such flat plate or bracket onto the flat cable, a punching operation is carried out to punch three holes. One such hole which is relatively small passes through the flat plate and flat cable to accommodate a stud which cooperates with a take-off cable to the truck control circuitry or accessory equipment. A central hole is punched through the flat cable in the middle of the relatively large plate opening, the purpose being to form a hole in the flat cable to receive therethrough a battery stud associated with the aforementioned battery post. A third hole is punched through the flat plate and flat cable to accommodate a separate stud which cooperates with a take-off cable to a truck starter.

In accordance with a unique feature of the present invention, the stud which cooperates with a take-off to the truck control circuitry and the stud which cooperates with a take-off to the truck starter are each connected to the flat plate or bracket in a manner which prevents rotation of such studs relative to the jumper cable assembly. The foregoing is an important advantage when applying nuts over the studs during the assembly process.

The foregoing objects and advantages of the invention will be apparent from the following description of certain preferred embodiments thereof, taken in conjunction with the accompanying drawings.

DESCRIPTION OF THE DRAWINGS

FIG. 8 is a top plan view of the plate of FIG. 7 showing eight projecting arms pre-formed into partially bent positions;

FIG. 9 is a front elevational view of the plate of FIG. 8;

FIG. 10 is an end view of the pre-formed plate of FIG. 8;

FIG. 11 is a vertical section taken through the line 11—11 of FIG. 2;

FIG. 12 is a vertical section taken through the line 12—12 of FIG. 1; and

FIG. 13 is a vertical section taken through the line 13—13 of FIG. 1;

Now, in order to acquaint those skilled in the art with the manner of making and using our invention, we shall describe, in conjunction with the accompanying drawings, certain preferred embodiments of the invention.

DETAILED DESCRIPTION OF THE INVENTION

Figure 1:
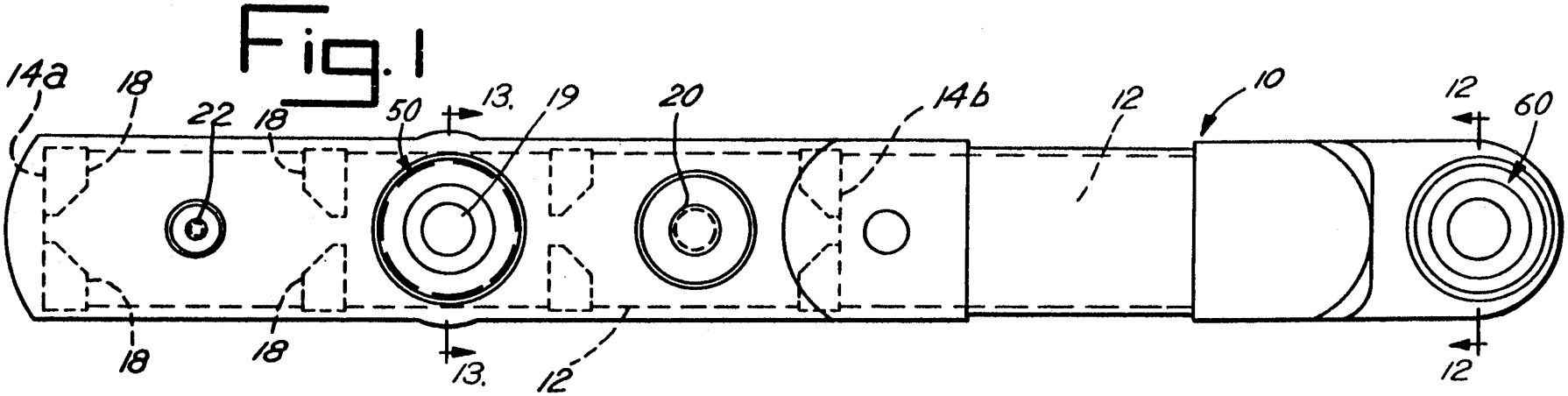
FIG. 1 is a top plan view of a battery jumper cable assembly constructed in accordance with the present invention, the embodiment shown being intended to connect two truck batteries in line.
Figure 2:
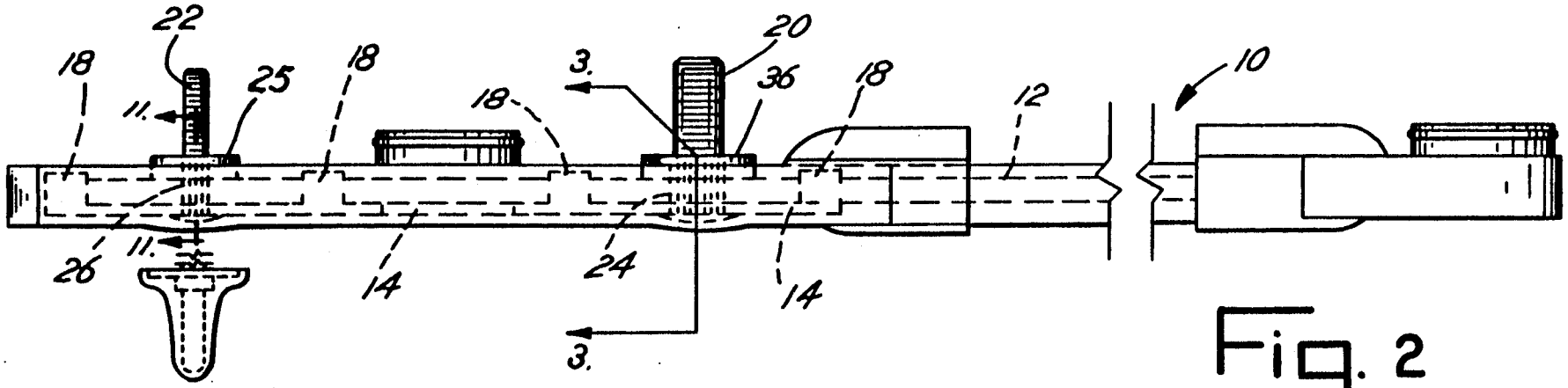
FIG. 2 is a vertical elevation of the battery jumper cable assembly of FIG. 1.
Figure 3:
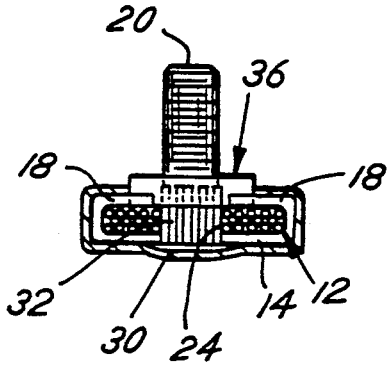
FIG. 3 is a vertical sectional view taken along the line 3—3 of FIG. 2.

FIGS. 1 and 2 show a battery jumper cable assembly which includes as a component thereof a length of flat, braided cable 12 which runs substantially the full length of the assembly and is made of a conductive material such as tin-coated copper. FIG. 3 is a sectional view which illustrates the flat cable in cross-section.

Figure 7:
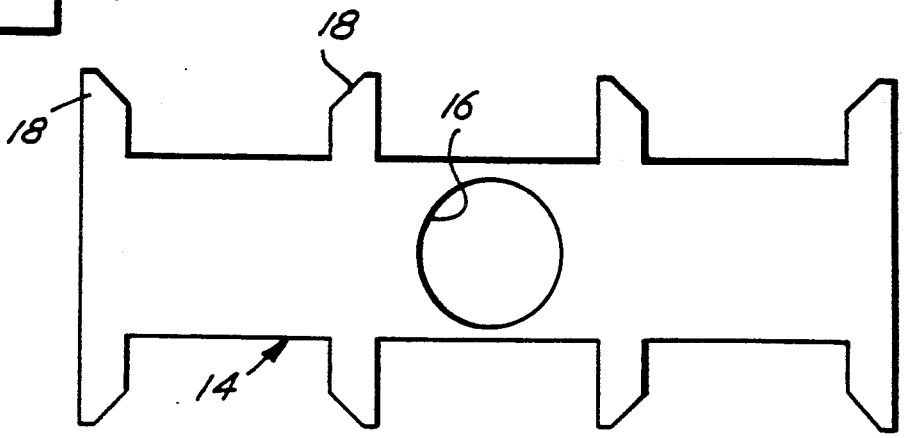
FIG. 7 is a top plan view of a flat plate or bracket which is a component of the jumper cable assembly of FIG. 1.

FIGS. 7-10 show a flat plate 14 which is combined with the flat cable 12 to form a unique and advantageous combination. FIG. 7 shows the flat plate or bracket 14 as initially stamped and having a relatively large central opening 16. The flat plate is formed with eight projecting arms 18 which are used to wrap around and secure the plate to a section of the flat cable 12. FIGS. 8-10 show the arms 18 in pre-formed or partially bent positions. After the bracket or plate 14 is assembled to a section of the flat cable 12, the arms 18 are more fully bent firmly around the flat cable as best shown in FIG. 3.

Referring again to FIGS. 1 and 2, the left end of the plate 14 is shown at 14*a* in FIG. 1 and the right end is shown at 14*b*. As shown in those drawings, and also in FIG. 3, the length of flat plate 14 is positioned beneath the length of uninsulated, flat, braided cable 12, and the eight arms 18 are bent over the top of the flat cable to firmly secure the flat plate or bracket to the underside of the flat cable 12.

FIGS. 1-3 show a stud 20 which is fixedly secured to the jumper cable assembly so it cannot rotate or otherwise move relative to such assembly. Also shown is a second stud 22 (See also FIG. 11) which is also fixedly secured to the jumper cable assembly so that it cannot rotate or otherwise move relative to the assembly. FIGS. 7 and 8 illustrate the large central opening 16 which is initially stamped in the flat plate 14. After that plate has been firmly secured to the underside of the flat cable 12 as shown in FIGS. 1-3, three additional holes are punched through the assembly of the flat cable 12 and the flat plate 14.

One such hole is shown at 24 in FIG. 3 and it passes through both the flat plate 14 and the flat cable 12 to accommodate the stud 20. A similar but smaller hole 26 is punched through the flat plate and cable adjacent the other end of the plate 14 to accommodate the stud 22 as shown in FIGS. 2 and 11. While only two such additional holes 24 and 26 are punched in the plate 14, in addition to the central opening 16, a third hole 17 is punched through the flat, braided cable at the center of the plate opening 16 for the purpose of receiving therethrough a battery stud 19, as will be described hereinafter.

Referring again to FIG. 3, the stud 20 includes at one end a head 30 adjacent to which is a splined stud section which is press-fitted in an interference fit through the round hole 24 in the plate 14 and flat cable 12. The interference fit between the splined stud section 32 and the hole 24 in the plate 14 serves to prevent the stud 20 from rotating relative to the jumper cable assembly. The foregoing is an important advantage of the battery jumper cable assembly. The splines would not cooperate with the opening in the flat copper cable in a manner sufficient to prevent rotation of the stud 20. However, the interference fit between the splined stud section 32 and the plate hole 24 is sufficient to prevent rotation of the stud, particularly if the plate 14 is made of a relatively hard material such as steel, even though that material is substantially less conductive than copper, to achieve the mechanical result of rendering the stud 20 non-rotatable.

FIG. 3 further shows a washer 36, preferably made of copper, which is press-fitted over the splined end of the stud 20 and soldered in position in electrical contact with the top of the flat, braided cable 12. As a result, electrical current in the flat cable 12 will pass to the copper washer 36 and then to a copper take-off terminal (not shown) which is connected to a take-off cable for connecting the truck batteries to a truck starter as previously described. Such a terminal may be fitted over the projecting upper threaded end of the stud 20 and held down firmly in known fashion by a suitable nut.

When making such a connection, it is highly advantageous that the stud 20 cannot be rotated relative to the jumper cable assembly, because a nut may then be tightened firmly on the stud without need to hold the stud. The splined stud 22 is mounted in the plate 12 in a fashion similar to that described above relative to the stud 20 so it also is non-rotatable relative to the jumper cable assembly as best shown in FIG. 11. The stud 22 is provided with a splined section 23, and a copper washer 25 is press-fitted over the splined section 23 of the stud and soldered in position in electrical contact with the top of the flat, braided cable 12. The same advantage is thus provided in that a take-off terminal (not shown) which is connected to a take-off cable for connecting the truck batteries to control circuitry in the truck may be secured down over the stud 22 and firmly held in place by a nut in the usual manner. A copper washer 25 is press-fitted over a splined section of the stud 22 and soldered in position in electrical contact with the top of the flat cable 12 so that electric current from the cable 12 will pass through the copper washer 25 to such a take-off terminal which also is preferably of copper.

As indicated above, each of the non-rotatable studs 20 and 22 is preferably associated with a copper washer and also with a copper take-off terminal (not shown) so that electric current in the flat cable 12 will pass through each copper washer and then to a corresponding copper take-off terminal which is passed over the stud and clamped down by a corresponding nut in known fashion. In such a manner, the battery current will pass from the flat cable 12 to a copper washer and then to a copper take-off terminal and related cable to the truck starter and to the truck control circuitry, respectively. Because the plate 14 is preferably made of steel, which is substantially less conductive than copper, it is preferred that a conductive battery post pass through the opening 16 in the flat plate or bracket 14 to make direct face-to-face contact with the underside of the flat copper cable as will be described below.

FIG. 13 is a section through line 13—13 of FIG. 1 where there is located a terminal 50 for the purpose of connecting the jumper cable assembly 10 to one of a plurality of truck batteries. As best shown in FIG. 13, a conductive battery post 52, projects up through the hole 16 in the plate 14 so as to make direct face-to-face engagement and electrical contact with the flat, braided, copper cable 12. In the foregoing manner, electric current from the associated battery is conducted to the flat copper cable 12 and washers 25 and 36 previously described (See FIG. 2).

The associated battery stud 19 projects up through the smaller opening 17 in the flat cable 12 to a height sufficient to receive thereon a nut 56 which is applied over the upper end of the battery stud 19 and firmly connects the battery jumper assembly 10 to the post 52 of one of a plurality of truck batteries to be interconnected.

Referring to FIG. 1, the right-hand end of the steel plate 14 is shown at **14*b*, and further to the right the flat cable 12 is flexible as there is no relatively rigid plate 14 to rigidify the same. At the right end of cable 12 there is shown a second battery terminal 60 which is shown in section in FIG. 12. In this instance, a plate 62 is affixed to the top of cable 12 for reinforcing purposes. A battery post (not shown) can make direct electrical contact with the underside of the flat cable 12. An opening 64 is formed through both the copper plate 62 and the flat cable 12** so that a battery stud (not shown) may pass upwardly therethrough and be firmly held in place by a nut (not shown).

It is important to understand that while the section of the battery jumper assembly along the length of steel plate 14, between **14*a* and 14*b* as shown in FIG. 1, is relatively rigid, and while the area immediately adjacent battery terminal 60 is relatively rigid to due to reinforcing plate 62, the length of flat cable 12** intermediate those rigid areas is relatively flexible to permit vertical shifting of a plurality of truck batteries when a truck is in use, particularly on a bumpy road.

Figure 6:
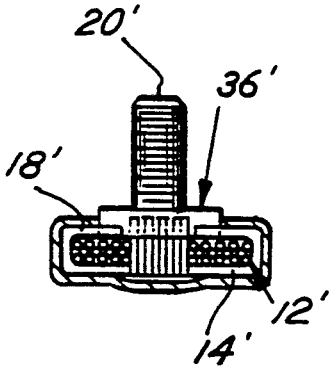
FIG. 6 is a vertical section taken along the line 6—6 of FIG. 5.
Figure 4:
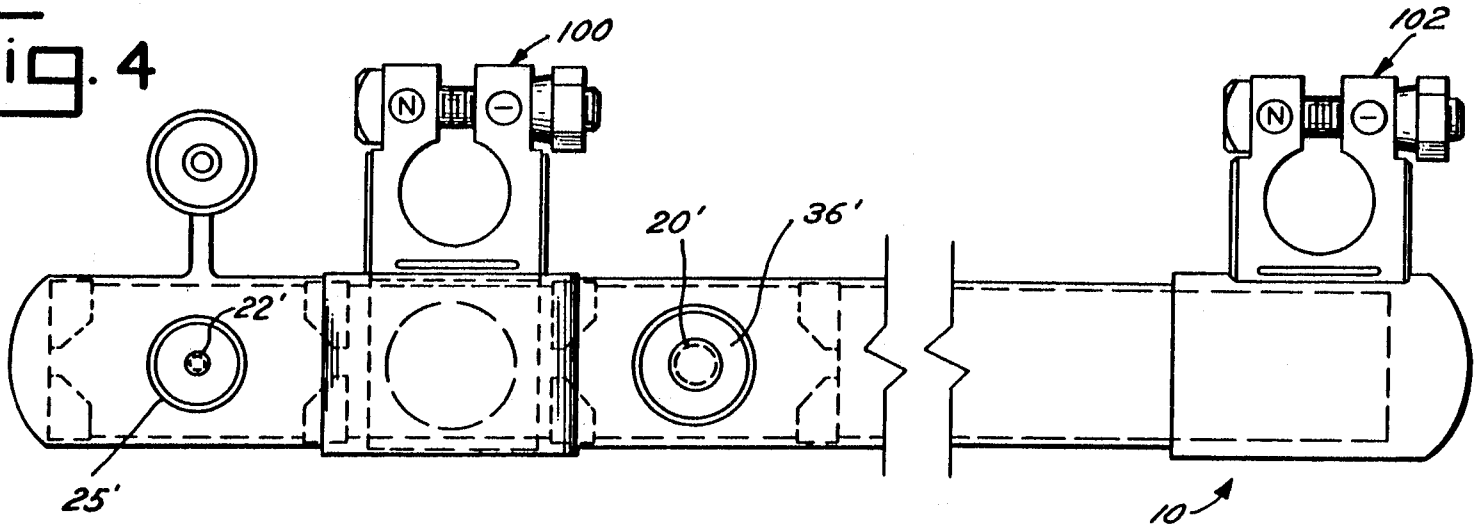
FIG. 4 is a top plan view of an alternative form of battery jumper cable assembly constructed in accordance with the present invention, where a pair of known clamping members are provided to clamp over a battery stud, there being shown two such clamping members so the jumper cable can interconnect two in-line truck batteries.
Figure 5:
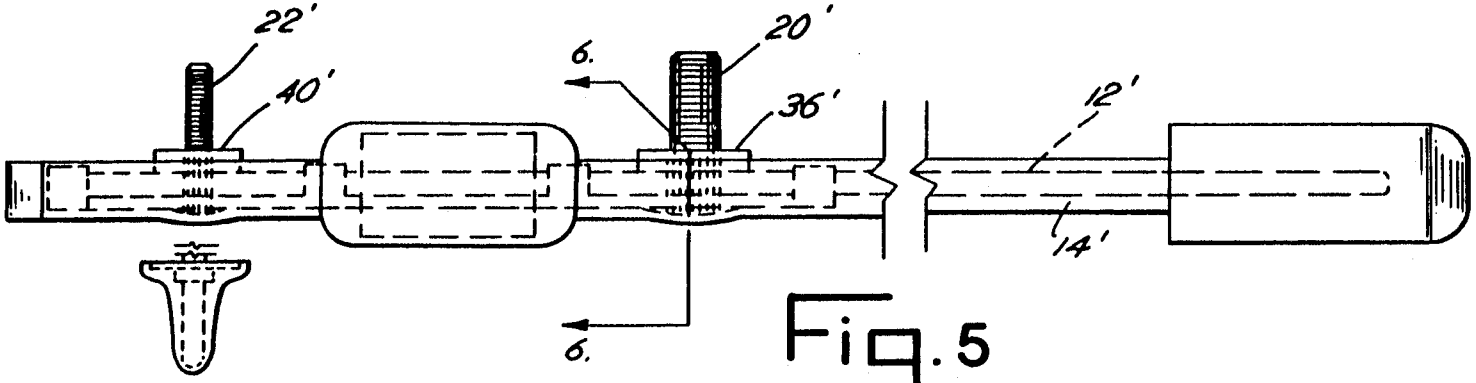
FIG. 5 is a front elevational view of the jumper cable assembly of FIG. 4.

FIGS. 4–6 show an alternative embodiment of the battery jumper cable of the present invention as adapted for use with a different type of known connection to a plurality of studs of truck batteries to be connected. Where components in FIGS. 4–6 are the same as shown in FIGS. 1–3, corresponding primed reference numerals are used. Thus, the jumper cable assembly of FIGS. 4–6 includes a stud 20' and a stud 22' that are of the same structure and same purpose as the studs 20 and 22 in the embodiment of FIGS. 1–3. In addition, FIGS. 4–6 illustrate a flat cable 12' and a flat plate or bracket 14' having securing arms 18', all of which are similar to corresponding components in the embodiment of FIGS. 1–3 (See FIG. 6).

The flat plate 14' does not require the central opening 16 to receive therethrough a battery stud as in the earlier embodiment. Instead, the jumper cable assembly of FIGS. 4–6 includes first and second clamp members 100 and 102 which are of known construction and serve to receive and clamp on corresponding battery studs to make electrical connection between two batteries to be connected with each other and with the flat cable 12' which connects the batteries to each other and to the copper washers 36' and 25' for take-off purposes as previously described.

The clamp assembly 100 clamps over a conductive battery stud in conventional fashion. However, in accordance with the present invention, the clamp assembly 100, which is preferably made of lead, is die cast directly onto the flat, braided copper cable 12' and the flat plate or bracket 14', so the clamp assembly 100 becomes integral with the flat cable 12' and flat bracket 14' with the result that electric current from a lead battery stud (not shown) passes through the lead clamping member 100 to the flat cable 12' and from there it passes to the copper washers 36' and 25' in the manner previously described.

The flat plate or bracket 14' in the embodiment of FIGS. 4–6 functions in the same manner as the flat plate 14 in the embodiment of FIGS. 1–2, except for the fact that the central opening 16, if present in the embodiment of FIGS. 4–6, is not utilized to accommodate a battery post because the battery stud is received instead in the clamping member 100.

In fabricating a battery jumper cable assembly in accordance with the present invention, it is preferred that the conductive washers such as shown at 36 and 25 in FIG. 2, and also the flat, braided cable 12, be made of tin-coated copper. After the components shown in FIG. 2 are assembled, it is desirable to wave solder the entire length of the assembly which encompasses the flat plate or bracket 14. It is further desirable to coat or over mold polyvinyl chloride or other suitable non-conductive insulating material over the entire assembly, excepting only those surfaces which must remain conductive such as the copper washers 36 and 25 and the portion of the underside of the flat cable 12 which is to be contacted by a battery post.

While the battery jumper cable assembly shown in FIGS. 1 and 2, shows terminals for connection with only two batteries, the flat cable may be extended from either end thereof, and one or more additional battery terminals may be added so that any desired number of batteries may be connected in line with a single battery jumper cable assembly.

Regardless of how many batteries are being interconnected, only one of the flat plates as shown at 14 is required because under normal circumstances only one stud 20 will be required for a take-off to a truck starter and only one stud 22 will be required for a take-off to truck control circuitry. Accordingly, the section of the battery cable jumper assembly between the ends **14*a* and 14*b* of the plate 14 as shown in FIG. 1 will be rigid, but the remaining length of flat cable 12** will be flexible so as to facilitate relative vertical movement of a plurality of truck batteries as previously described.

In an embodiment as shown in FIGS. 4 and 5, in addition to the main flat plate 14' which mounts the splined studs 20' and 22', it may be desirable to utilize a shorter length of flat plate to reinforce the flat cable 12' in the area where the clamp member 102 is die cast onto the cable, e.g., a short of plate with four arms 18'.

In accordance with the present invention, the flat plate shown at 14 is preferably made of steel so it can firmly restrain the studs 20 and 22 against rotation after those studs are press-fitted into corresponding holes in the plate. If such plate were made of copper, the large central plate opening 16 would not be required because a battery post could contact directly against the underside of such a highly conductive copper plate. However, it is because we prefer to use a steel plate for mechanical reasons, and such a plate is not highly conductive, we utilize the central plate opening 16 so a battery post can pass through the plate 14, and make direct face-to-face contact with the more conductive flat copper cable 12.

In use of the battery jumper cable assembly of the present invention, the preferred procedure is to first mount the battery terminal located between the studs 20 and 22 over stud 19 of one of the batteries, after which nut 56 may be used to firmly clamp the plate portion of the jumper cable assembly to one battery, leaving the studs 20 and 22 projecting upwardly. The remaining one or more battery terminals as at 60 may then be connected to additional corresponding battery studs to connect all of the truck batteries in line. Finally, the take-off studs 20 and 22 may be used to apply a take-off cable to the truck starter and a second take-off cable to the truck control circuitry.

What is claimed:

1. A battery jumper cable assembly comprising, in combination, a length of flexible, flat, conductive cable, at least two battery terminals mounted in spaced relation along said cable for connecting at least two corresponding batteries in line electrically with said cable, relatively rigid terminal means fixed to said cable along a portion of the length thereof, and at least one take-off stud means mounted to said rigid terminal means and said cable to project therefrom and be non-rotatable relative thereto.

2. A battery jumper cable assembly as defined in claim 1 where two take-off stud means are mounted to said rigid terminal means and said cable in spaced relation along the length thereof to project therefrom and be non-rotatable relative thereto, one stud means being for connecting said batteries to a truck starter and the other stud means being for connecting said batteries to control circuitry in a truck.

3. A battery jumper cable assembly as defined in claim 1 where said relatively rigid terminal means is made of steel and said cable is made of copper.

4. A battery jumper cable assembly as defined in claim 1 where conductive washer means is mounted over said stud means for making electrical contact with a terminal associated with a take-off cable for supplying electric current from said batteries to a truck starter.

5. A battery jumper cable assembly as defined in claim 1 where said relatively rigid terminal means includes an opening for receiving said therethrough a battery post which can pass through said opening and make face-to-face contact with said cable, said cable having a second opening to receive therethrough a battery stud associated with said battery post.

6. A battery jumper cable assembly as defined in claim 1 where said relatively rigid terminal means comprises plate means affixed to a portion of the length of said cable on one side thereof.

7. A battery jumper cable assembly as defined in claim 6 where said plate means is affixed to said cable by a plurality of arms extending from said plate means which are bent around the edges of said cable.

8. A battery jumper cable assembly as defined in claim 1 where said stud means includes a non-round section which is pressed into a hole in said relatively rigid terminal means to prevent rotation of said stud means relative to said terminal means.

9. A battery jumper cable assembly as defined in claim 8 where said non-round section comprises a splined section.

10. A truck battery jumper cable assembly comprising, in combination, a length of flexible, flat, conductive cable, at least two battery terminals mounted in spaced relation along said cable for connecting at least two corresponding batteries in line electrically with said cable, relatively rigid terminal means fixed to said cable along a portion of the length thereof, first stud means mounted to said rigid terminal means and said cable to project therefrom and be non-rotatable relative thereto for cooperation with a take-off cable to a truck starter, second stud means mounted to said rigid terminal means and said cable to project therefrom and be non-rotatable relative thereto for cooperation with a second take-off cable to truck control circuitry, said first and second stud means being spaced along the length of said cable and projecting from the same side thereof.

11. A truck battery jumper cable assembly as defined in claim 10 where said relatively rigid terminal means comprises plate means affixed to a portion of the length of said cable on one side thereof.

12. A truck battery jumper cable assembly as defined in claim 10 where one of said battery terminals is mounted to said relatively rigid terminal means intermediate said first and second stud means.

13. A truck battery jumper cable assembly as defined in claim 12 including a first conductive washer mounted over said first stud means for making electrical contact with a terminal associated with said first take-off cable and a second conductive washer mounted over said second stud means for making electrical contact with a terminal associated with said second take-off cable.

14. A truck battery jumper cable assembly as defined in claim 12 where said first and second stud means each includes a non-round section which is pressed into a corresponding opening in said relatively rigid terminal means to prevent rotation of said first and second stud means relative to said terminal means.

15. A truck battery jumper cable assembly as defined in claim 14 where said relatively rigid terminal means is made of steel and said cable is made of copper.

16. A truck battery jumper cable assembly comprising, in combination, a length of flexible, flat, conductive cable, at least two battery terminals mounted in spaced relation along said cable for connecting at least two corresponding batteries in line electrically with said cable, relatively rigid plate means fixed to said cable along a portion of the length thereof, one of said battery terminals being mounted to said plate means in a central area thereof, first stud means mounted to said plate means on one side of said one battery terminal to project upwardly from said plate means and be non-rotatable relative thereto for cooperation with a first take-off cable, second stud means mounted to said plate means on a second side of said one battery terminal to project upwardly from said plate means and be non-rotatable relative thereto for cooperation with a second take-off cable, a second one of said battery terminals being mounted on said flexible cable in spaced relation to said plate means.

17. A truck battery jumper cable assembly as defined in claim 16 where said plate means and cable include a first opening to receive said first stud means and a second opening to receive said second stud means, each of said first and second stud means having a non-round section pressed into its corresponding opening to render the stud means non-rotatable relative to said plate means.

18. A truck battery jumper cable assembly as defined in claim 17 where said cable is made of copper and said plate means is made of steel, said plate means having a third opening intermediate said first and second openings to permit a battery post to pass through said third opening into face-to-face contact with said cable.

19. A truck battery jumper cable assembly as defined in claim 18 where said first and second stud means include splined sections which are pressed into corresponding round holes in said plate means to prevent rotation of said first and second stud means relative to said plate means.

20. A truck battery jumper cable assembly as defined in claim 19 including a first conductive washer mounted over said first stud means for cooperation with a terminal on said first take-off cable and a second conductive washer mounted over said second stud means for cooperation with a terminal on said second take-off cable.

21. A truck battery jumper cable assembly comprising, in combination, a length of flexible, braided, flat copper cable, at least two battery terminals mounted in spaced relation along said cable for connecting at least two corresponding batteries in line electrically with said cable, relatively rigid steel plate means fixed to said cable along a portion of the length thereof, one of said battery terminals being mounted to said plate means in a central area thereof, said plate means having three spaced holes formed therethrough, first and second ones of said holes also projecting through said cable and a third central hole in said plate means being aligned with said one battery terminal, first stud means mounted through said plate and cable in a first one of said holes and including a splined section pressed into said hole in said plate means to prevent rotation of said stud means, said first stud mean projecting upwardly from said plate means for cooperation with a first take-off cable, second stud means mounted through said plate and cable in a second one of said holes and including a splined section pressed into said hole in said plate means to prevent rotation of said stud means, said second stud means projecting upwardly from said plate means for cooperation with a second take-off cable, and a second one of said battery terminals being mounted on said flexible cable in spaced relation to said plate means, said third central hole in said plate means serving to permit a battery post to project therethrough into face-to-face contact with said cable, and a further hole being formed in said cable centrally of said third hole to permit a battery stud to project through said plate and cable at said one battery terminal.

22. A truck battery jumper cable assembly as defined in claim 21 where said plate means is affixed to said cable by a plurality of arms extending from said plate means which are bent around the edges of said cable.

23. A truck battery jumper cable assembly as defined in claim 21 including a pair of copper washers, one mounted over each of said first and second stud means for contact with corresponding terminals associated with said first and second take-off cables.

* * * * *